US007597565B1

(12) United States Patent
Jorgensen

(10) Patent No.: US 7,597,565 B1
(45) Date of Patent: Oct. 6, 2009

(54) CONTINUOUS SLIDING ELECTRICAL CONTACT TAPE

(75) Inventor: Glen H. Jorgensen, Kihei, HI (US)

(73) Assignee: Textron Systems Corporation, Wilmington, MA (US)

( * ) Notice: Subject to any disclaimer, the term of this patent is extended or adjusted under 35 U.S.C. 154(b) by 0 days.

(21) Appl. No.: 12/046,010

(22) Filed: Mar. 11, 2008

(51) Int. Cl.
*H01R 25/00* (2006.01)

(52) U.S. Cl. ..... 439/111; 439/113

(58) Field of Classification Search ..... 439/110, 439/111, 23–26, 67
See application file for complete search history.

(56) References Cited

U.S. PATENT DOCUMENTS

| | | | | |
|---|---|---|---|---|
| 2,856,592 | A * | 10/1958 | Carlson | 439/119 |
| 3,314,038 | A | 4/1967 | Rutten | |
| 4,621,777 | A | 11/1986 | O'Conner | |
| 4,861,273 | A * | 8/1989 | Wenman et al. | 439/111 |
| 5,224,138 | A | 6/1993 | Hirao et al. | |
| 5,295,055 | A * | 3/1994 | Brock et al. | 362/249 |
| 5,461,482 | A | 10/1995 | Wilson et al. | |
| 5,618,192 | A * | 4/1997 | Drury | 439/110 |
| 5,734,218 | A | 3/1998 | Crockett et al. | |
| 5,745,976 | A | 5/1998 | Crockett et al. | |
| 5,746,606 | A | 5/1998 | Sobhani | |
| 5,772,315 | A * | 6/1998 | Shen | 362/396 |
| 5,876,862 | A | 3/1999 | Shibuya et al. | |
| 6,059,582 | A * | 5/2000 | Tsai | 439/121 |
| 6,716,042 | B2 * | 4/2004 | Lin | 439/110 |
| 6,739,740 | B1 * | 5/2004 | Feldman | 362/404 |
| 6,991,468 | B1 | 1/2006 | Lynch et al. | |
| 7,092,257 | B2 * | 8/2006 | Westerheide | 361/784 |
| 7,137,727 | B2 * | 11/2006 | Joseph et al. | 362/648 |
| 7,237,932 | B2 * | 7/2007 | Ter-Hovhannissian | 362/485 |
| 2002/0171313 | A1 | 11/2002 | Queener et al. | |
| 2006/0012977 | A1 * | 1/2006 | Joseph | 362/147 |

FOREIGN PATENT DOCUMENTS

EP 1320154 A 6/2003

OTHER PUBLICATIONS

Anonymous, "Wiring System for a Rotative Machine Applying EMC 89/336 Guidelines," Research Disclosure, Mason Publications, Hampshire, GB, vol. 416, No. 42, Dec. 1, 1998.
International Search Report and Written Opinion for PCT/US2009/032570, mailed on Apr. 17, 2009.

* cited by examiner

*Primary Examiner*—Neil Abrams
*Assistant Examiner*—Harshad C Patel
(74) *Attorney, Agent, or Firm*—BainwoodHuang

(57) ABSTRACT

The electrical tape has a flexible conductor strip defining a conductor strip contact surface configured to interact with a first electrical connector and a second electrical connector, the flexible conductor strip being arranged to provide electrical connectivity between the first electrical connector and the second electrical connector. The electrical tape has a flexible insulator portion substantially surrounding the flexible conductor strip, the flexible insulator portion being arranged to expose the conductor strip contact surface along the length of the tape.

14 Claims, 5 Drawing Sheets

CONTINUOUS SLIDING ELECTRICAL CONTACT TAPE

BACKGROUND

A slip ring is a device which enables two members, which rotate relative to each other, to stay in electrical communication. For example, a small telescope may have a base which includes a stationary portion and a movable portion which rotates relative to the base. A slip ring installed between the stationary portion and the movable portion provides continuous electrical connectivity between these portions (e.g., to control a telescope motor, to convey optical or radio signals captured by the telescope, etc.).

If a cable were used in place of the slip ring, it would be possible for the cable to become awkwardly wound around the telescope and/or for the cable to become severely twisted around itself. Considerable manual effort would be required to prevent the cable from tangling and/or interfering with access around the telescope.

Conventional slip rings come in a variety of standard sizes. When designing an apparatus which uses a slip ring, a designer typically identifies a general size of the moving parts of the apparatus. Next, the designer selects a particular standard sized slip ring, and configures the precise dimensions of the moving parts of the apparatus to that standard sized slip ring.

SUMMARY

Unfortunately, there are deficiencies to the above-described approach to designing an apparatus which involves configuring precise dimensions of the moving parts of the apparatus to a pre-selected standard sized slip ring. In such an approach, the physical requirements of the slip ring often dictate and limit other aspects of the apparatus.

In some situations, the available or lack of availability of certain standard sizes may determine the upper or lower bounds of the apparatus. For example, the neck size of a relative large telescope may be limited by the largest standard sized slip ring that is currently available off the shelf. As another example, the number of electrical paths through the slip ring may place an upper bound on the number of signals that are passed between the moving and stationary portions.

If there are no standard-sized slip rings available to satisfy a particular design requirement (e.g., a movable roof for a very large telescope), it is common to use a customized rigid rail system in which metallic wheels or brushes fixed to one structure (e.g., the roof) contact metallic rails fixed to another structure. Such a customized rigid rail system suffers from certain drawbacks such as the need to fasten the various parts to their structures (e.g., using bolts, welding, etc.), and the need to keep the various parts clean and in good working order (e.g., dirt, oxidation, rail fractures, etc. can affect electrical conductivity). Additionally, the rigid rail system poses a safety concern.

Another deficiency to the above-described conventional approaches to designing an apparatus which involves configuring precise dimensions of the moving parts of the apparatus to a pre-selected standard sized slip ring is dealing with electromagnetic interference (EMI). Slip rings typically leave their conductive pathways open and exposed. Outside electromagnetic interference can corrupt transmitted signals across the slip ring. Additionally, external electromagnetic interference may influence the signals across the slip ring. Such operation can cause a reliability concern.

In contrast to the above-identified conventional approaches to designing an apparatus which involves employing a customized rail system or which involves using a pre-selected standard sized slip ring, an improved electrical connection technique involves using a flexible conductor laid upon a flexible insulator in the form of a ribbon like tape to create an electrical contact track. Such a track could be cut to any desired length to perform the functions of a slip ring of any size. The designing of apparatuses would not have their geometries limited to the available slip ring sizes. Additionally, since the tape can be installed in an inexpensive manner, they can be replaced periodically to avoid the cleaning and maintenance associated with customized rigid rail systems used for larger apparatuses. Furthermore, some embodiments utilize flexible EMI shielding strips over the track slot to provide EMI shielding for the electrical contacts that interact with the track.

One embodiment is directed to an electrical connector tape. The electrical tape has a flexible conductor strip defining a conductor strip contact surface configured to interact with a first electrical connector and a second electrical connector, the flexible conductor strip being arranged to provide electrical connectivity between the first electrical connector and the second electrical connector. The electrical tape has a flexible insulator portion substantially surrounding the flexible conductor strip, the flexible insulator portion being arranged to expose the conductor strip contact surface along the length of the tape.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

An improved technique for conveying signals between two structures which move relative to each other involve the use of flexible conductive material which forms an electrical contact track. The electrical contact track can be cut to any desired size and shaped for many applications thus alleviating the need to employ standard sized slip rings or cumbersome rigid rail systems.

Figure 1:
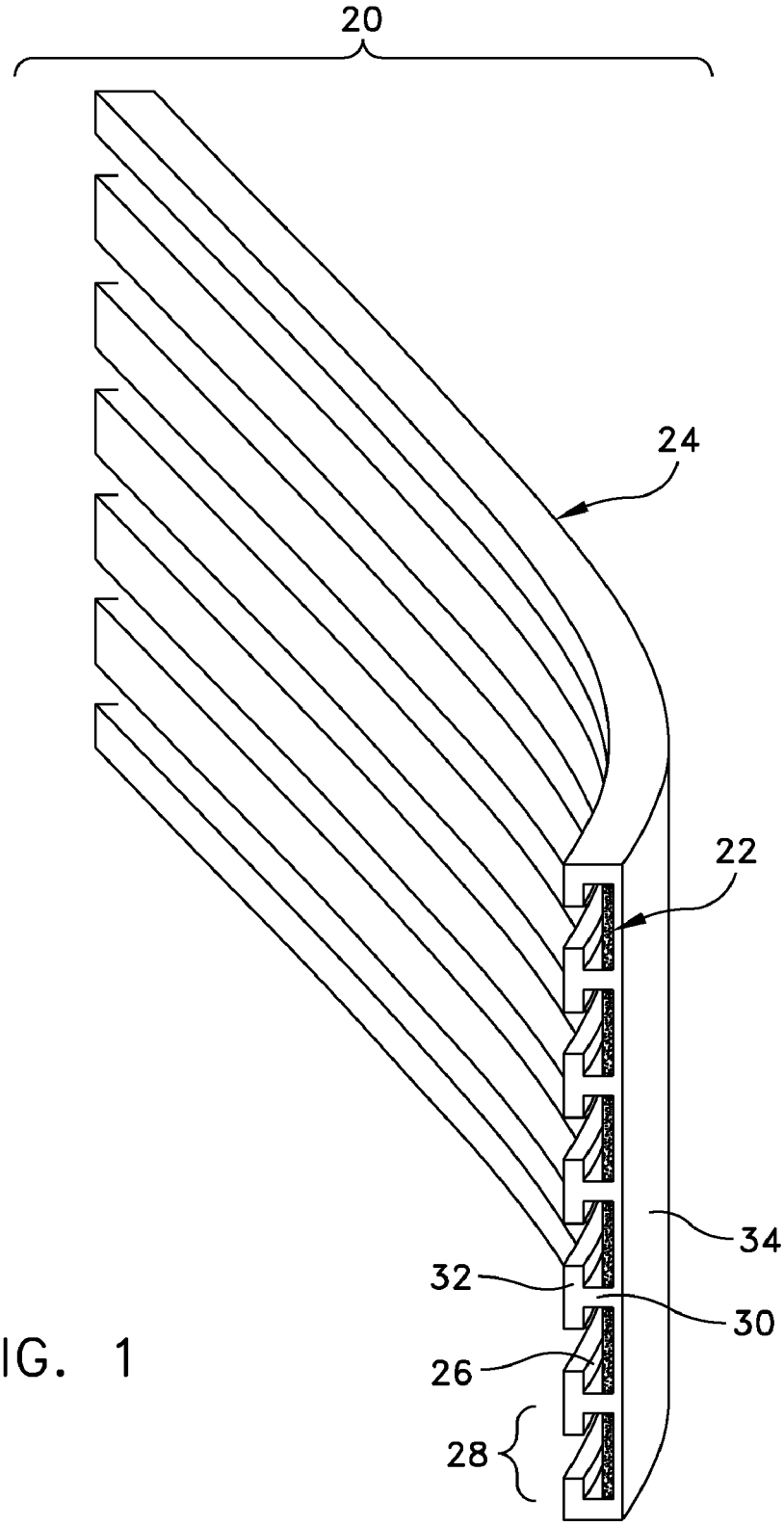
FIG. 1 is a perspective view of an electrical connector tape having a flexible conductor strip, and a flexible insulator portion.

FIG. 1 shows an electrical connector tape 20 which includes a set of flexible conductor strips 22 (i.e., individual runs of compliant conductive material), and a flexible insulator portion 24 (i.e., non-conductive material which is arranged to support each flexible conductor strip 22). Each flexible conductor strip 22 defines a conductor strip contact surface 26. The flexible insulator portion 24 includes a set of connector slot walls 30 and a set of connector slot tabs 32 which bound a set of connector slots 28. The flexible insulator portion 24 also defines a mounting surface 34.

As shown in FIG. 1, the electrical connector tape 20 is formed by embedding each flexible conductor strip 22 in the flexible insulator portion 24. Each flexible conductor strip 22 is capable of being made of any type of conductor that is pliable enough to bend into various shapes without breaking. Such materials include aluminum, copper, gold, other electrically conductive compliant materials, combinations thereof, etc. The flexible insulator portion 24 is also made of any type of insulator that is pliable enough to bend into various shapes without breaking but nevertheless insulates each flexible conductor strip 22 from the external environment (e.g., a conductive mounting surface). Furthermore, the flexible insulator portion 24 substantially retains its shape to provide protection and support to the set of flexible conductor strips 22. Such materials include plastics, rubbers, nylon, and others. Each flexible conductor strip 22 is attached to the flexible insulator portion 24 by various methods including adhesives, mechanical connections, molding together, friction fits, and others.

This electrical conductor tape 20 is well suited for use in applications similar to those that use slip rings. However, in contrast to conventional slip rings, the flexible nature of the electrical conductor tape 20 allows custom conductive connecting structures to be cut and bent to any size. The electrical conductor tape 20 can be wrapped around any joint or rotating shaft to provide electrical connection across it.

As shown in FIG. 1, the connector slot walls 30 of the flexible insulator portion 24 extend along the flexible conductor strip 22. The connector slot tabs 32 extend from the connector slot walls 30. In one embodiment, the connector slot walls 30, the connector slot tabs 32, and the connector strip contact surface 26 bound an area to form the connector slot 28. In another embodiment, the connector slot walls 30 and the connector strip contact surface 26 forms the connector slot 28 (no connector slot tabs 32 are present). In yet another embodiment, there are no connector slot walls 30 or connector slot tabs 32. In this embodiment the connector slot 28 is just the area above the connector strip contact surface 26. The presence of connector slot walls 30 and connector slot tabs 32 allows for greater shielding of the connector strip contact surface 26 but are not necessary for all applications. FIG. 1 shows an electrical connector tape 20 with six connector slots 28. Other numbers of connector slots 28 are possible (as few as one connector slot 28).

As shown in FIG. 1, the flexible insulator portion 24 contains the mounting surface 34 which acts as the interface between the electrical connector tape 20 and the joint or shaft to which it will be affixed. The mounting surface 34 may contain adhesives to stick to the desired joint or shaft. However this is not required.

Figure 2:
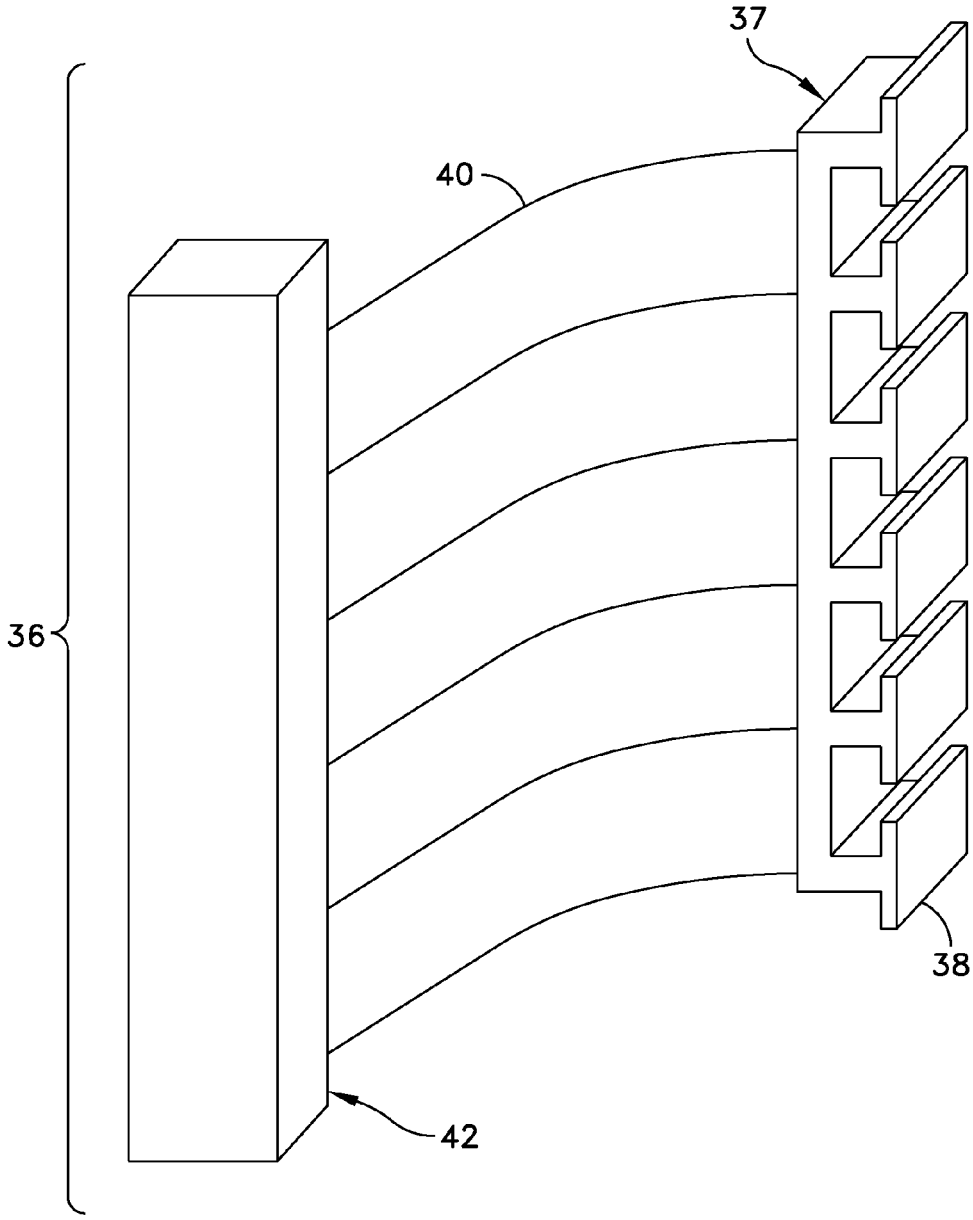
FIG. 2 is a perspective view of an electrical connector apparatus having a set of stator pickoffs, a set of connector wires, and an electrical connector.

FIG. 2 shows an electrical connector assembly 36. The electrical connector assembly 36 includes a non-conductive support member 37, a set of pickoffs 38 (i.e., one or more pickoffs 38), a set of wires 40 (i.e., one or more wires 40), and an electrical connector 42. The non-conductive support member 37 positions the pickoffs 38 at locations which correspond to the flexible conductor strips 22 of the electrical conductor tape 20 (FIG. 1) as well as rigidly holds the pickoffs 38 in place to keep them electrically isolated from each other. The set of wires 40 enables the electrical connector 42 (e.g., a standard electrical connector) to electrically connect to the pickoffs 38.

As shown in FIG. 2, the electrical connector assembly 36 is a device which is able to maintain electrical communication with the electrical connector tape 20 but nevertheless move relative to the electrical connector tape 20. That is, the pickoffs 38 are designed to travel along the connector slots 28 and wipe against (i.e., make contact with) corresponding flexible conductor strips 22. There can be any number of pickoffs 38 (at least one) in the electrical connector assembly 36, but often there will be as many pickoffs 38 as there are connector slots 28. The pickoffs 38 can come in various forms including metallic pads or contacts, brushes, wheels, and mercury bubbles.

As shown in FIG. 2, the pickoffs 38 are connected electrically to the electrical connector 42 by the connector wires 40. The electrical connector 42 interacts with other devices to deliver or receive electrical signals. One way of using the electrical connector apparatus 36 with the electrical connector tape 20 is to have the electrical connector apparatus 36 be in a fixed position and have the electrical connector tape 20 be in motion. For example the electrical connector tape 20 could be wrapped around a rotating shaft to form a conductive loop. A static device that outputs an electrical signal could then be attached to the electrical connector apparatus 36 whose pickoff 38 slides along the connector slot 28 that moves with the rotating shaft. Another way of using the electrical connector apparatus 36 with the electrical connector tape 20 is to have the electrical connector apparatus 36 be in motion and have the electrical connector tape 20 be in a fixed position. For example the electrical connector tape 20 could be rapped around a fixed shaft to form a conductive loop. A device that rotates around the fixed shaft and is configured to receive an electrical signal could then be attached to the electrical connector apparatus 36 whose pickoff 38 slides along the connector slot 28 as it rotates around the shaft.

Figure 3:
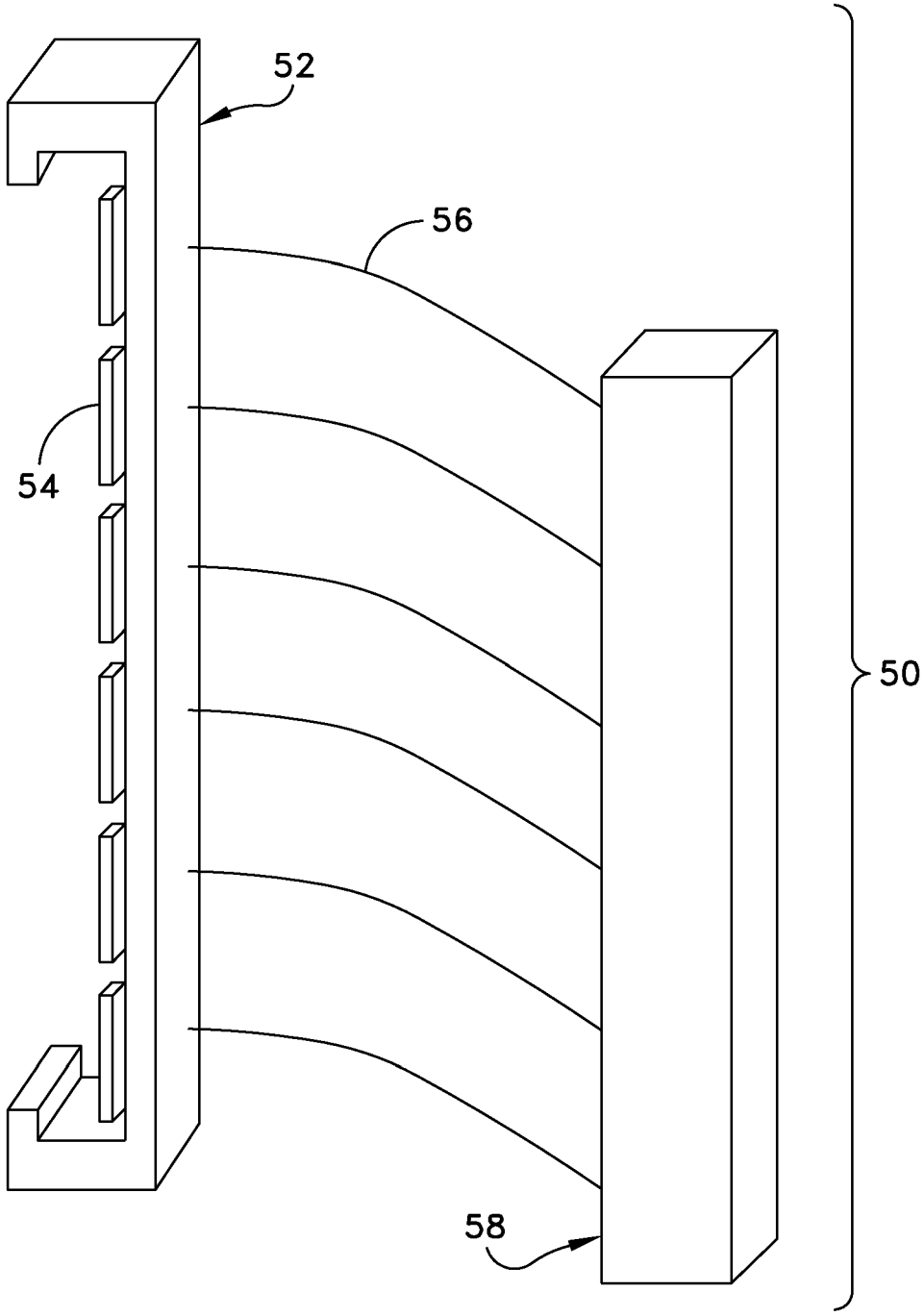
FIG. 3 is a perspective view of an electrical connector connected to a tape fastener by a set of connector wires.

FIG. 3 shows an electrical connector apparatus 50 which enables convenient connection to the electrical conductor tape 20. The electrical connector apparatus 50 includes a non-conductive support member 52, a set of contacts 54, a set of wires 56, and an electrical connector 58. The non-conductive support member 52 positions the contacts 54 at locations which correspond to the flexible conductor strips 22 of the electrical conductor tape 20 (FIG. 1) as well as rigidly holds the contacts 54 in place to keep them electrically isolated from each other. The set of wires 56 enable the electrical connector 58 (e.g., a standard electrical connector) to electrically connect to the contacts 54. As shown in FIG. 3 the non-conductive support member 52 is used to attach to the ends of the electrical connector tape 20 to enable the tape 20 to form a complete loop. That is, the electrical connector tape 20 is cut to a desired length for an application and bent into a loop. The loop is closed together and held by the non-conductive support member 52. The contacts 54 provide for electrical connectivity between the ends of the flexible conductive strip 22. This creates a conductive loop in the electrical connector tape 20 that will behave in a similar electrical manner to slip rings by enabling the electrical connector tape 20 to form a continuous loop but still enable electrical signals to enter or exit.

Unlike the electrical connector apparatus 36, the tape fastener 50 is not arranged to travel along the track of the electrical connector tape 20. Instead the electrical connector apparatus 36 is arranged to remain at the ends of the electrical connector tape 20. This allows the device to send signals across the shaft that is not moving at the same angular velocity.

Figure 4A:
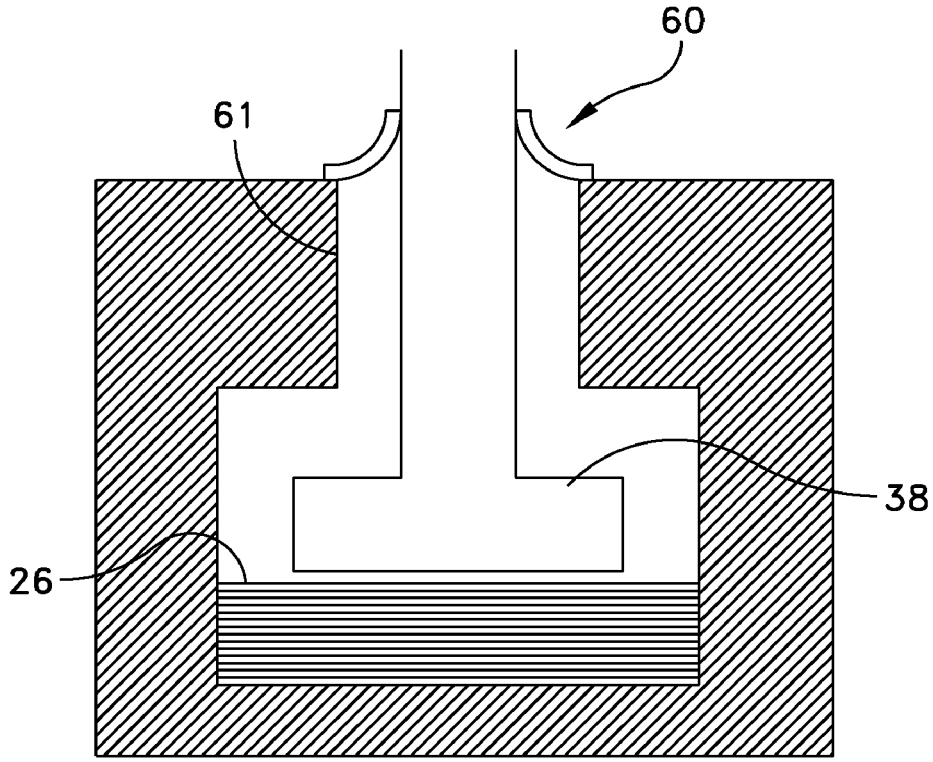
FIG. 4*a* is a cross section view of a portion of the electrical connector tape having a set of EMI shielding strips with the stator pickoff inserted.
Figure 4B:
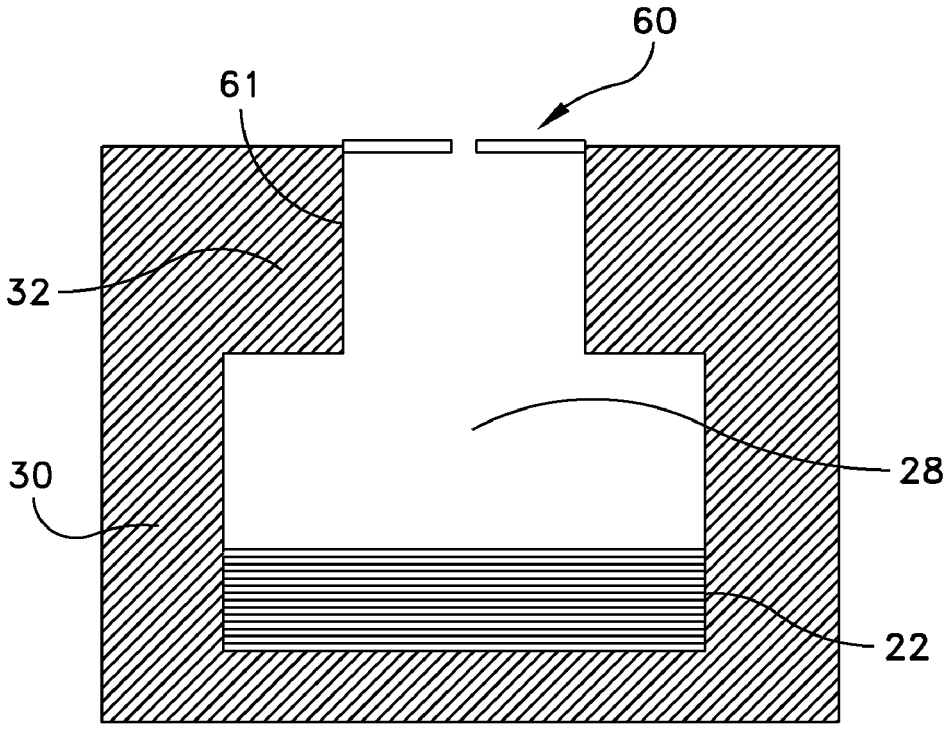
FIG. 4*b* is a cross section view of a portion of the electrical connector tape having a set of EMI shielding strips without the stator pickoff inserted.

FIGS. 4*a* and 4*b* show a close up cross-sectional view of the electrical connector tape 20 as seen with and without the pickoff 38 inserted into the connection slot 28, respectively. Although the pickoff 38 is shown slightly above the connector strip contact surface 26 of the flexible conductor strip 22 in FIG. 4*a*, it should be understood that robust and reliable electrical connectivity exists between the pickoff 38 and the strip 22 when the pickoff 38 resides within the track. The electrical connector tape 20 includes a set of EMI shielding strips 60 (i.e. at least one EMI shielding strip 60).

As shown in FIGS. 4*a* and 4*b*, EMI shielding is employed by placing the EMI shielding strips 60 over the connector slot 28. The EMI shielding strips 60 are made of a flexible conductive material to form an EMI gasket for the connector slots 28. In one embodiment, the surface of the electrical connector tape 20 is coated in a conductive material 61. The conductive material on the surface of the electrical connector tape 20 and the EMI shielding strips 60 are electrically grounded. This will effectively shield the electrical connector tape 20 from electromagnetic interference noise. The flexible nature of the EMI shielding strips 60 allow the pickoffs 38 to pass through the connector slots 28 freely while preserving EMI protection. Other EMI shielding structures are suitable for use as well (e.g., metallic fabric, foil, other compliant EMI shielding materials, etc.).

Figure 5:
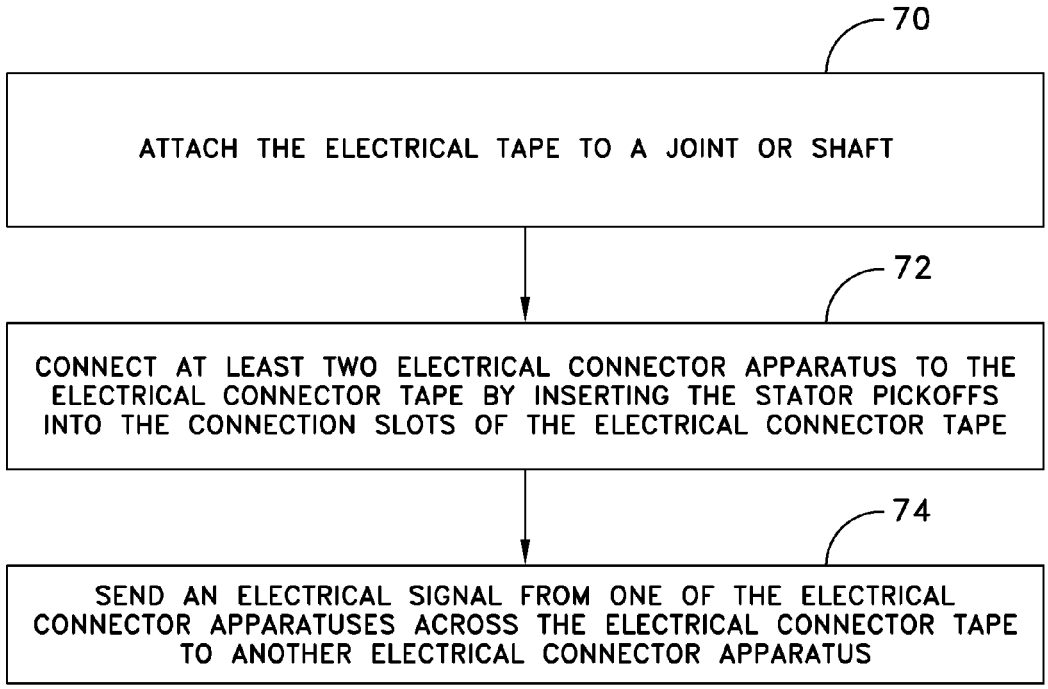
FIG. 5 is a flowchart of a procedure which involves using the electrical connector tape of FIG. 1.

FIG. 5 shows a method for using the electrical connector tape 20. Step 70 involves attaching the electrical connector tape 20 to a joint or shaft. This can be done in various ways. In some embodiments the electrical connector tape 20 is flexible, but rigid enough to maintain its shape once it has been bent in a certain orientation in a similar way that a wire coat hanger maintains its shape when bent. In this circumstance the electrical connector tape can be bent to mechanically hold itself in place. In another embodiment, the mounting surface 34 of the connector tape 20 is coated with an adhesive. In this circumstance, the electrical connector tape is stuck to the joint or shaft desired in a similar way that duct tape is stuck to a surface.

Step 72 involves connecting at least two electrical connector apparatuses 36 to the electrical connector tape 20 by inserting the stator pickoffs 38 into the connection slots 28 of the electrical connector tape 20. The electrical connector apparatuses 36 are inserted in such a way that the stator pickoffs 38 are in electrical contact with the flexible conductor strip 22. This electrical contact is maintained even as the stator pickoffs 38 are moved along the connection slot 28.

Step 74 involves sending an electrical signal from one of the electrical connector apparatuses across the electrical connector tape to another electrical connector apparatus. Since both electrical connector apparatuses 36 are in electrical contact with the flexible conductor strip, electrical signals can be sent across the electrical conductor strip 22 even when the electrical connector apparatuses 36 are moving along the connector slot 28.

While various embodiments of the invention have been particularly shown and described, it will be understood by those skilled in the art that various changes in form and details may be made therein without departing from the spirit and scope of the invention as defined by the appended claims.

For example, it should be understood that the tape 20 is capable of residing on a first structure and the electrical connector assembly 36 is capable of residing on a second structure which moves relative to the first structure. Either the first or the second structure may be movable relative to the ground. In some embodiments, both structures are movable relative to the ground.

Additionally, it should be understood that the tape 20 is shown in FIG. 1 and by way of example as bending so that the openings to the tracks face inward. Such an arrangement is well suited for an inner facing application (e.g., the tape 20 is installed on an inner surface of a cylinder). In such an arrangement, the electrical connector assembly 36 resides on a central member and faces the tape 20 (e.g., the electrical connector assembly 36 resides on the outer wall of the central member and the central member sits within the cylinder and rotates relative to the cylinder).

Alternatively, it should be understood that the tape 20 is capable of bending so that the openings to the tracks face outward. Such an arrangement is well suited for an outward facing application (e.g., the tape 20 is installed on an outer surface of a central cylinder). In such an arrangement, the electrical connector assembly 36 resides on a member that surrounds the central cylinder and faces the tape 20. Such arrangements as well as others are suitable for use by various embodiments of the invention.

What is claimed is:

1. An electrical connector tape, comprising:

a flexible conductor strip defining a conductor strip contact surface configured to interact with a first electrical connector and a second electrical connector, the flexible conductor strip being arranged to provide electrical connectivity between the first electrical connector and the second electrical connector; and a flexible insulator portion substantially surrounding the flexible conductor strip, the flexible insulator portion being arranged to expose the conductor strip contact surface along the length of the tape;

wherein the flexible conductor strip is configured to maintain electrical connectivity between the first electrical connector and the second electrical connector while at least one of the first electrical connector and the second electrical connector glide against the flexible conductor strip along the length of the tape;

wherein the flexible insulator portion defines a connector slot along which the first electrical connector passes; and wherein the electrical connector tape further comprises:

a conductive coating disposed on an outer surface of the flexible insulator portion, the conductive coating being electrically grounded, and a set of EMI shielding strips connected to the conductive coating, the set of EMI shielding strips being configured to, in conjunction with the conductive coating, provide EMI isolation to the connector slot defined by the flexible insulator portion regardless of whether the first electrical connector resides within the connector slot defined by the flexible insulator portion.

2. The electrical connector tape of claim 1 wherein the flexible insulator portion includes:

a set of connector slot walls that extend along the sides of the flexible conductor strip leaving only the conductor strip contact surface exposed; and wherein the set of EMI shielding strips extends from the ends of the connector slot walls to define a tab gap that is less than a width of the conductor strip contact surface.

3. The electrical connector tape of claim 1 wherein the flexible conductor strip further defines ends which are constructed and arranged to join via a tape coupler, the tape coupler having a set of connection bridges that electrically connect to the ends of the flexible conductor strip forming a conductive loop, the conductive loop configured to continuously interact with the first electrical connector and the second electrical connector as the first electrical connector rotates relative to the conductive loop thus maintaining the electrical connection between the first electrical connector and the second electrical connector.

4. The electrical connector tape of claim 3 wherein the tape coupler is attached to the second electrical connector.

5. The electrical connector tape of claim 1 wherein the flexible insulator portion defines a mounting surface, an adhesive covering the mounting surface.

6. The electrical connector tape of claim 1:

wherein the flexible insulator portion defining the connector slot is configured to (i) receive a stator pickoff of the first electrical connector (ii) establish an electrical connection with the stator pickoff, and (iii) maintain the electrical connection with the stator pickoff as the stator pickoff moves along the connection slot.

7. An electrical connector system, comprising:

a first electrical connector configured to send an electrical signal;

a second electrical connector configured to receive an electrical signal; and an electrical connector tape having:

a flexible conductor strip defining a conductor strip contact surface configured to interact with the first electrical connector and the second electrical connector, the flexible conductor strip being arranged to provide electrical connectivity between the first electrical connector and the second electrical connector, and a flexible insulator portion substantially surrounding the flexible conductor strip, the flexible insulator portion being arranged to expose the conductor strip contact surface along the length of the tape, wherein the flexible conductor strip is configured to maintain electrical connectivity between the first electrical connector and the second electrical connector while at least one of the first electrical connector and the second electrical connector glide against the flexible conductor strip along the length of the tape;

wherein the flexible insulator portion defines a connector slot along which the first electrical connector passes; and wherein the electrical connector tape further includes:

a conductive coating disposed on an outer surface of the flexible insulator portion, the conductive coating being electrically grounded; and a set of EMI shielding strips connected to the conductive coating, the set of EMI shielding strips being configured to, in conjunction with the conductive coating, provide EMI isolation to the connector slot defined by the flexible insulator portion regardless of whether the first electrical connector resides within the connector slot defined by the flexible insulator portion.

8. The electrical connector system of claim 7 wherein the flexible insulator portion includes:

a set of connector slot walls that extend along the sides of the flexible conductor strip leaving only the conductor strip contact surface exposed; and wherein the set of EMI shielding strips extends from the ends of the connector slot walls to define a tab gap that is less than a width of the conductor strip contact surface.

9. The electrical connector system of claim 7 wherein the flexible conductor strip further defines ends and wherein the electrical connector system further comprises a tape coupler, the tape coupler constructed and arranged to connect the ends of the flexible conductor strip, the tape coupler having a set of connection bridges that electrically connect to the ends of the flexible conductor strip forming a conductive loop, the conductive loop configured to continuously interact with the first electrical connector and the second electrical connector as the first electrical connector rotates relative to the conductive loop thus maintaining the electrical connection between the first electrical connector and the second electrical connector.

10. The electrical connector system of claim 9 wherein the tape coupler is attached to the second electrical connector.

11. The electrical connector system of claim 7 wherein the flexible insulator portion defines a mounting surface, an adhesive covering the mounting surface.

12. The electrical connector system of claim 7:

wherein the flexible insulator portion defining the connector slot is configured to (i) receive a stator pickoff of the first electrical connector (ii) establish an electrical connection with the stator pickoff, and (iii) maintain the electrical connection with the stator pickoff as the stator pickoff moves along the connection slot.

13. A method of sending an electrical signal across a joint comprising:

attaching an electrical connector tape to a joint, the electrical connector tape having, a flexible conductor strip defining a conductor strip contact surface configured to interact with a first electrical connector and a second electrical connector, the flexible conductor strip being arranged to provide electrical connectivity between the first electrical connector and the second electrical connector, and a flexible insulator portion substantially surrounding the flexible conductor strip, the flexible insulator portion being arranged to expose the conductor strip contact surface along the length of the tape;

connecting the first electrical connector and the second electrical connector to the electrical connector tape;

sending an electrical signal from the first electrical connector across the electrical connector tape to the second electrical connector; and maintaining electrical connectivity between the first electrical connector and the second electrical connector while at least one of the first electrical connector and the second electrical connector glide against the flexible conductor strip along the length of the tape;

wherein the flexible insulator portion defines a connector slot along which the first electrical connector passes;

wherein the electrical connector tape further includes:

a conductive coating disposed on an outer surface of the flexible insulator portion, the conductive coating being electrically grounded, and a set of EMI shielding strips connected to the conductive coating, the set of EMI shielding strips being configured to, in conjunction with the conductive coating, provide EMI isolation to the connector slot defined by the flexible insulator portion regardless of whether the first electrical connector resides the connector slot defined by the flexible insulator portion.

14. The method of claim 13:

wherein connecting the first electrical connector to the electrical connector tape includes (i) receiving a stator pickoff of the first electrical connector (ii) establishing an electrical connection with the stator pickoff, and (iii) maintaining the electrical connection with the stator pickoff as the stator pickoff moves along the connection slot.

* * * * *

UNITED STATES PATENT AND TRADEMARK OFFICE

CERTIFICATE OF CORRECTION

PATENT NO. : 7,597,565 B1
APPLICATION NO. : 12/046010
DATED : October 6, 2009
INVENTOR(S) : Glen H. Jorgensen It is certified that error appears in the above-identified patent and that said Letters Patent is hereby corrected as shown below:

On the title page insert item (65), should read: -- (65) Prior Publication Data
US 2009/0233457 A1 Sept. 17, 2009 --

Signed and Sealed this

Twenty-second Day of December, 2009

David J. Kappos

David J. Kappos
*Director of the United States Patent and Trademark Office*